US010889999B2

(12) United States Patent
Sahr

(10) Patent No.: US 10,889,999 B2
(45) Date of Patent: Jan. 12, 2021

(54) METHOD FOR APPLYING GRAPHIC PRODUCT TO HARDWOOD FLOOR

(71) Applicant: GameTime Graphics Limited, North Little Rock, AR (US)

(72) Inventor: Robert L. F. Sahr, Little Rock, AR (US)

(73) Assignee: GameTime Wraps, L.L.C., Little Rock, AR (US)

( * ) Notice: Subject to any disclaimer, the term of this patent is extended or adjusted under 35 U.S.C. 154(b) by 408 days.

(21) Appl. No.: 15/862,051

(22) Filed: Jan. 4, 2018

(65) Prior Publication Data

US 2019/0203482 A1 Jul. 4, 2019

(51) Int. Cl.

| | |
|---|---|
| ***E04F 15/10*** | (2006.01) |
| ***E04F 15/16*** | (2006.01) |
| ***E04F 15/12*** | (2006.01) |
| ***B44C 1/16*** | (2006.01) |

(52) U.S. Cl.

CPC ..... *E04F 15/107* (2013.01); *B44C 1/16* (2013.01); *E04F 15/12* (2013.01); *E04F 15/163* (2013.01); *E04F 2290/00* (2013.01)

(58) Field of Classification Search

CPC ..... B44C 1/16; B44C 3/005

See application file for complete search history.

(56) References Cited

U.S. PATENT DOCUMENTS

2003/0203165 A1* 10/2003 Nobles ..... A47G 1/0627 428/195.1

2016/0075171 A1* 3/2016 Frainie ..... B44C 1/105 428/141

OTHER PUBLICATIONS

MFMA, New Maple Floor, https://www.maplefloor.org/TechnicalInfo/Sanding-and-Sealing/New-Maple-Floor.aspx, accessed Apr. 1, 2020, published 2017 or earlier. (Year: 2017).*

* cited by examiner

*Primary Examiner* — Kelly M Gambetta

(74) *Attorney, Agent, or Firm* — Wright, Lindsey & Jennings LLP; K. Brandon Middleton

(57) ABSTRACT

A system and method for installing a graphic design on a flooring surface, where a vinyl decal displaying the graphic design is applied to a flooring surface that has been coated with multiple layers of sealer, and where after application of the vinyl decal to the sealed floor, one or more additional layers of sealer are applied to the floor, covering the vinyl decal and the areas surrounding the vinyl decal, and finally one or more layers of floor finish are applied to the surface to result in a finished floor displaying the graphic design. Application of the vinyl decal may vary depending on characteristics of the graphic design, with some applications using a specially designed applicator device, some applications using a wet application method, and other applications using a hinged application method.

17 Claims, 2 Drawing Sheets

METHOD FOR APPLYING GRAPHIC PRODUCT TO HARDWOOD FLOOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Participating in and watching sporting events, whether in person or through a televised broadcast, is one of the most widely enjoyed activities in the United States. One sport in particular that people enjoy to watch is basketball. In 2017, over 30 million people attended college basketball games in the United States and millions of others watched these games on television. Given the magnitude of people to whom these games reach, it is no surprise that the teams, schools, and organizations that play and broadcast these games spend a large amount of money making their teams, schools, and gyms visually appealing to the millions of viewers. Teams are constantly working with large apparel companies to design fashion-forward, eye-catching uniforms. Likewise, schools and organizations whose gyms are used to play these games use graphics and decorations to make their gyms stand out from others.

One trend with these gyms is to use floor graphics to show their school's name, logo, or other intricate design. For years, these floor graphics have consisted of painted graphics. These traditional floor graphics are applied to the floor, which are generally made of hard wood such as maple, through a hand-painting process. After hand-painting of the graphics, the paint is sealed to the floor using a clear coat, which increases the permanency of the painted graphic. For years, this hand-painted graphic process was the only known method for achieving permanent graphic products on these flooring surfaces. And while these hand-painted graphics can be suitable for these permanent display requirements, the process for applying the hand-painted graphics can be burdensome. For example, because the graphic is made from paint, the process requires a high amount of "down time" to allow the paint to dry. This "down time" increases the amount of time before the floor can be used. For teams, this could mean missing out on valuable practice time, and for schools or organizations, this could mean missing out on opportunities to use the space for other events. Furthermore, because paint is used, there are some limitations to what colors, shapes, and designs can be used in the floor graphics. In a society that continuously strives for the next best design, these limitations could have a negative impact on the satisfaction of those sports enthusiasts who are showing up for games.

Other methods have been developed for achieving temporary graphic designs on these flooring surfaces. For example, some techniques have been developed for applying temporary decals to the finished top surface of the wooden floor. While these decals offer better color, shape, and design capabilities than does the hand-painted graphic, these decals generally take the general form of a "sticker" in that that a backing layer can be removed from the decal to expose an adhesive layer. The decal can then be applied to the top surface of the finished floor, with the adhesive layer working to adhere the decal to the finished floor. While these methods work for temporary decal placement (for example, a single-game sponsorship advertisement or a weekend tournament logo), because the decals are placed on top of the finished floor, they are susceptible to peeling and are easily removed from the floor's surface. For teams, schools, and organizations that want a permanent design (logo, school name, etc.), this type of decal application is not sufficient.

A product and process that can be used for applying permanent floor graphics in a time efficient manner and that can be used for a wide variety of graphic colors, shapes, and designs is needed.

BRIEF SUMMARY OF THE INVENTION

The present invention is directed to graphics for wood flooring and in particular to a method for applying a graphic decal to a hard wood floor. It is an object of the present invention to provide a method for applying a permanent floor graphic in a time efficient manner. It is also an object of the present invention to provide a method for application of floor graphics in various shapes, sizes, colors, and designs. In particular, the present invention is directed to series of steps for applying a vinyl decal floor graphic to a wooden floor, whereby the use of the specially designed floor sealer and the application of the vinyl decal and other layers in a specific order results in a permanent floor graphic. This process, for example, can result in floor graphics that remain unblemished and in an aesthetically pleasing condition for years. These and other objects, features, and advantages of the present invention will become better understood from a consideration of the following detailed description of the preferred embodiments and appended claims in conjunction with the drawings as described following:

DETAILED DESCRIPTION OF THE INVENTION

The present invention is directed to a process for application of a graphic design to a flooring surface and in particular to a method for applying a vinyl decal product to a hard wood floor resulting in a substantially permanent floor graphic design. For purposes of convenience, the present invention may be described with reference to application of a vinyl decal graphic to a maple wood floor. It is understood, however, that any decal material may be used and that the surface to which the decal is applied may be any material and is not limited to a floor.

Figure 1:
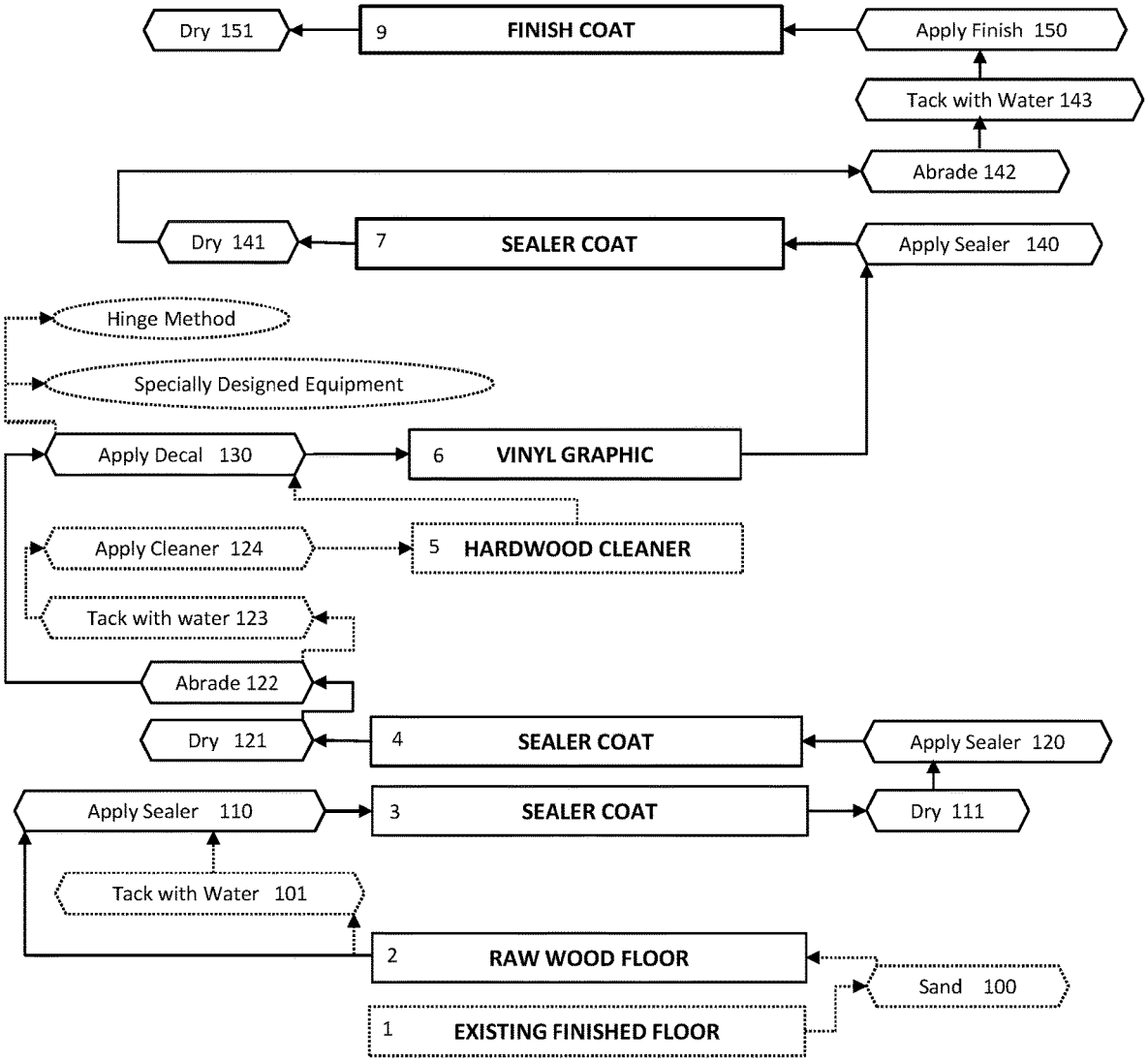
FIG. 1 is a flow diagram showing the steps of the method of applying a permanent decal according to the preferred embodiment of the present invention.

Referring to FIG. 1, the method of application of the graphic design 6 to the flooring surface 2 may be described. First, in order to achieve permanent graphic design placement, it is important that the process begin with an untreated, unfinished surface. In the preferred embodiment, for example, the process begins with a raw maple wood floor 2. Alternatively, the process may begin with a previously finished wood floor 1 that is sanded down until it is raw wood at step 100. The raw surface, whether new raw wood 2 or a sanded existing finished floor 1, is necessary, as the mere application of a vinyl decal 6 to an already treated or finished surface is insufficient to create a permanent result (while it is understood that a permanent result may be obtained using a pre-finished floor and multiple layers of sealer and finish, the preferred embodiment utilizes a raw wood floor). In addition to sanding, other means for prepping the flooring surface may be implemented at step 100. For example, the surface may be prepped with the additional steps of screening, cleaning, or tacking to result in a clean, prepped surface. In addition, in one embodiment, raw wood floor 2 may also be screened, cleaned, tacked, or otherwise prepped for graphic application at step 101. In the preferred embodiment, the floor is prepped by tacking the floor with water at step 101.

Once the surface has been prepped for application and a clean raw wood floor surface 2 is obtained, the remaining steps of the graphic installment process may begin. In the preferred embodiment, a first coat of sealer 3 is applied to the clean, prepped, raw wood floor 2 at step 110. The sealer 3 is preferably a waterborne polyurethane hybrid, which has unique characteristics sufficient to create a high adhesion between the floor surface 2 and the graphic decal 6 (described below), resulting in an increased permanency of application. Once a first coat of sealer 3 has been applied at step 110, sufficient time should be given to allow the sealer 3 to dry at step 111. In the preferred embodiment, the first coat of sealer 3 should be allowed to dry at step 111 for approximately three to four hours, but shorter or longer drying periods may be required depending on the characteristics of the environment in which the process is being performed. For example, the humidity or temperature of the environment may require shorter or longer drying time at step 111.

After applying the first sealer coat 3 at step 110, an additional layer of sealer 4 is applied at step 120. The second layer of sealer 4 is dried at step 121 in the same manner as the first coat of sealer 3. Once the second coat of sealer 4 is dried for an amount of time depending on environmental factors, the surface of the coat of sealer 4 is abraded at step 122 to provide a smooth surface for graphic application. In the preferred embodiment, this abrading step 122 is performed using an abrasive pad (which is preferably what is known in the art as a maroon abrasive pad). Alternatively, floor stripping or buffing pads may be used. The sealer coating surface 4 should be abraded such that the grain raise is knocked off, resulting in a smooth even surface for graphic installation. Grain raise typically occurs when water-based coatings are used on wooden surfaces, which results in the wood fibers sticking up from the wood. This screening process allows those fibers to be removed from the surface of sealer coat 4, so that a smooth even surface is provided for the graphic application. The surface of sealer layer 4 may also be tacked at step 123 to further result in a smooth even surface for graphic application.

After application 120 and drying 121 of the sealer layers 3, 4, and the abrading 122 and tacking 123 of sealer layer 4, the next step is to apply at step 130 the graphic design 6 itself to the sealed 3, 4 wood surface 2. In the preferred embodiment, a vinyl graphic decal 6 is used. The vinyl graphic decal 6 is designed and manufactured off site according to the specifications provided by the school, organization, team, or other intended user. Use of a vinyl graphic 6 allows for a multitude of various designs, colors, and shapes that are difficult, if not impossible, to achieve using hand-painted graphics. For example, a vinyl product allows for intricate designs that use blended colors with seamless transitions and may even be used to provide graphics with somewhat "three-dimensional" optical characteristics. The use of the vinyl product 6 also drastically reduces the application time, from weeks to days or even hours. Generally speaking, the vinyl decal 6 used in this application process has various components, including a design layer (the vinyl graphic layer) and a peel-off backing layer, which when peeled off of the vinyl layer exposes an adhesive that can be used to provide a more permanent adhesion to the surface. Once the back layer is removed, the vinyl graphic 6 is lined up with premeasured floor markings for placement.

The vinyl graphic decal 6 can be applied in any location on the sealed 3, 4 flooring surface 2, and can be used to create center-floor logos or even be used for marking the out-of-bounds, free-throw, or three-point lines on a basketball court. Decal application step 130 may vary slightly depending on unique characteristics of the desired graphic design. For example, for designs requiring the use of larger vinyl decal graphics 6, a "wet application" process may be used. This wet application process utilizes hardwood cleaner 5 and an applicator (which for example, may be a squeegee applicator), to apply 124 the hardwood cleaner 5 only to the portion of the sealed 3, 4 wood surface 2 the graphic 6 will be covering. Once this hardwood cleaner layer 5 is applied to the surface at step 124, the vinyl decal 6 is ready to be applied at step 130.

After placement of the vinyl graphic 6 in the appropriate location corresponding to pre-marked measurements, a means for eliminating any air and hardwood cleaner 5 from between the vinyl layer 6 and the sealer coats 3, 4 on the floor surface 2 is used to flatten out the edges of the vinyl graphic 6 such that the graphic 6 is arranged in a smooth, even plane on the sealed 3, 4 floor surface 2. For example, a squeegee or other device can be used to push the air and cleaner out, working in a side-to-side manner or middle-to-edge manner. In some instances, particularly for oversized vinyl graphic application, a "hinge" method of application may be used. In this case, the center of the graphic 6 is first held in place on the appropriate floor location and only a portion of the vinyl graphic 6 is applied at a time. That is, for example, only a portion of the back layer of the graphic 6 is removed, and only that portion of the graphic 6 is adhered to the sealed 3, 4 flooring surface 2. Once the application of the first portion is complete, the process can be repeated for the remaining portion of the graphic 6.

In addition to variations in the application process depending on size of the graphics 6, the application process may also slightly vary depending on the type of graphic 6 being applied. For example, while the application steps described above may be better suited for application of larger graphics 6 such as logos, a slight modification of the process may be needed to apply the "game lines" or other non-logo graphics. For example, basketball courts have straight lines marking the outer boundaries of the court and other lines marking the free-throw line, three-point line, "paint" area under the goal, and center court lines. Because these lines are merely straight or circular lines (instead of large intricate designs used for logos), a modified application process must be used. That is, while the overall process is similar in that vinyl graphics 6 are applied to a floor 2 coated with sealer 3, 4, the particular steps for installing the vinyl graphic 6 to the surface 2 may be slightly different. In one embodiment, a specially designed game line applicator device (described below) may be used instead of the "wet apply" or "hinged" method described above for larger graphics.

This specially designed game line application is preferably a machine equipped with heavy duty polyurethane wheels and bearings of approximately one-half inch, allowing the device to have the capability of high rpms up to three-hundred pounds. The device uses a vinyl spool as the graphic applicator and may optionally have an extension for improving mobility and usability of the device, such that, for example, the device can be used by a user in the upright, walking position. A laser is mounted to the front of the device, allowing the user to apply the vinyl decal in the appropriate position. Vinyl is spooled around the roller and applied to the floor with the correct pressure to adhere the vinyl to the floor. A secondary polyurethane roller may also be mounted to the device. This device allows the application of vinyl decals in straight lines without requiring extensive measuring or other time-consuming processes required with hand-painted graphics. Curved or circular lines (for example, three-point lines on basketball courts) can also be applied with this process with slight modifications. After application of the sealer to the flooring surface, an applicator device having an arm of a fixed or customizable radius is used to apply these curved lines to the floor surface. A double-spooled apparatus attached to the applicator's arm is used to apply the vinyl at the appropriate radius or distance from a central anchor point.

After application 130 of the vinyl decal 6 to the sealed 3, 4 flooring surface 2 according to one of the various application procedures discussed above, the vinyl decal 6 is installed on the flooring surface 2, but further steps are necessary to enhance the permanency of the graphic 6 (whether it is a logo or some other design or simply straight or curved lines needed to play the game). First, an additional sealer coat 7 is layered over the flooring surface 2 at step 140, on both the area covered by the vinyl graphic 6 and the non-covered areas (as in general, the vinyl graphic 6 covers only a portion of the flooring surface 2). That is, the coating of sealer 7 is applied directly to the vinyl graphic 6 and to the surrounding areas of the sealed 3, 4 wood floor 2, such that the sealer 7 extends over the edges of the vinyl graphic 6, increasing the permanency of the graphic installment. In the preferred embodiment, only a single additional coat of sealer 7 is required, but additional layers can be added if desired. As with the previous coats of sealer 3, 4, sufficient time should be given to allow the each additional sealer coating 7 to dry at step 141, with three to four hours being the preferred time, depending on environmental conditions. After drying in step 141, the final sealer layer should be abraded at step 142 in the same manner described above.

Once the vinyl graphic 6 has been applied to the sealed 3, 4 floor 2 and the additional layer or layers of sealer 7 have been applied, a final floor finishing product 9 is applied at step 150 to the surface 2 to create the permanent graphic result. As with the sealer layer 7, the floor finish should be applied at step 150 to the area of the flooring surface 2 covered by the vinyl graphic 6, along the edges of the vinyl graphic 6, and to the remaining area of the flooring surface 2 that is not covered by vinyl graphic 6. This increases the permanency of the vinyl graphic installation.

Furthermore, the finishing product 9 applied at step 150 can vary depending on desired characteristics. For example, an oil based poly finish or a water-based finish may be used. A water-based finish may be desired in time sensitive applications, as water-based finishes typically require less drying time (step 151) than oil based finishes. Furthermore, multiple layers of water-based finishing may be applied without requiring intermittent abrasive screening steps, as a hot coating technique is possible with water-based finishing. Oil based finishing, on the other hand, requires at least several hours of drying time at step 151 preferably allowing for an over-night drying period. The preferred vinyl application process uses one coat of sealer 7 and one coat of finish 9, but multiple coats of finish 9 may be applied if desired. The preferred finisher for use in the finishing application process 150 is a waterborne finish with high solid contents (approximately 50%), which allows the finish application process 150 to be implemented using only a single coating of finish 9. With the use of this quick finishing process 150 in addition to the lower time demands of the sealer application and vinyl decal application, a permanent graphic design can be applied to a surface in approximately half the time it takes for traditional hand-painted processes. After application 150 of the finish coat 9 (or multiple finish coats) and after sufficient drying of the finish coat(s), the floor with graphic design is ready for use.

Figure 2:
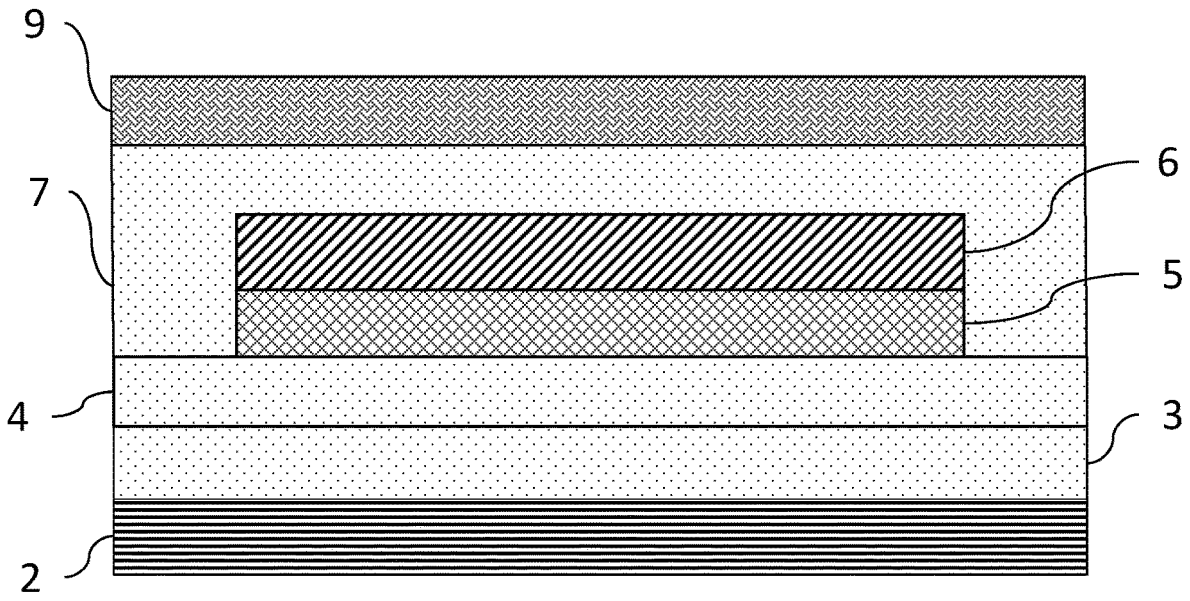
FIG. 2 a schematic showing a representative finished layered graphic configuration resulting from the method of applying a permanent decal according to the preferred embodiment of the present invention.

The configuration of the layers following application is represented by the schematic shown in FIG. 2. This schematic represents a representative cross-section of a fully installed graphic decal 6 according to the method described above. As shown, one or more sealer layers 3, 4 are coated on a flooring surface 2. A hardwood cleaner 5 is applied to the second sealer layer 4 and a vinyl decal 6 having the graphic design is applied over the hardwood cleaner 5. In the preferred embodiment, excess hardwood cleaner 5 is removed from beneath the vinyl decal 6 by application of pressure to the top of the applied vinyl decal 6. After application of the vinyl decal 6, one or more sealer layers 7 are applied to the area covered by the vinyl decal 6 and to the areas not covered by the vinyl decal 6. The overlapping of the sealer on the vinyl decal 6 and the area uncovered by the vinyl decal 6 increases the permanency of the vinyl decal 6. Finally, a finish layer 9 is also applied to the entire area, both the area covered by the decal 6 and the area uncovered by the decal to increase the permanency of the design.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. When a Markush group or other grouping is used herein, all individual members of the group and all combinations and subcombinations possible of the group are intended to be individually included. All references cited herein are hereby incorporated by reference to the extent that there is no inconsistency with the disclosure of this specification. When a range is stated herein, the range is intended to include all sub-ranges within the range, as well as all individual points within the range. When "about," "approximately," or like terms are used herein, they are intended to include amounts, measurements, or the like that do not depart significantly from the expressly stated amount, measurement, or the like, such that the stated purpose of the apparatus or process is not lost.

The present invention has been described with reference to certain preferred and alternative embodiments that are intended to be exemplary only and not limiting to the full scope of the present invention, as set forth in the appended claims.

The invention claimed is:

1. A method for installing a graphic design on a flooring surface, the method comprising the steps of:

a. prepping the flooring surface to provide a raw surface;
b. applying a first coat of a sealer to the raw surface;
c. drying the first coat of the sealer to create a first sealed surface;
d. applying a second coat of the sealer to the first sealed surface;
e. drying the second coat of the sealer to create a second sealed surface;
f. abrading the second sealed surface with an abrasive pad to create an abraded second sealed surface;
g. applying a vinyl decal comprising the graphic design on a first portion of the abraded second sealed surface, wherein the first portion of the abraded second sealed surface corresponds to an area of the abraded second seal surface to be covered by an entirety of the vinyl decal;
h. applying a third coat of the sealer to the first portion of the abraded second sealed surface and to a second portion of the abraded second sealed surface, wherein the second portion of the second sealed surface corresponds to all areas of the abraded second sealed surface not covered by the vinyl decal thereby applying the third coat of sealer both on the entirety of the vinyl decal and beyond a border of the entirety of the vinyl decal;
i. drying the third coat of the sealer to create a third sealed surface covering the entirety of the vinyl decal and an area beyond the border of the entirety of the vinyl decal;
j. abrading the third sealed surface with an abrasive pad;
k. applying a first coat of a finish to the abraded third sealed surface thereby covering the entirety of the vinyl decal and an area beyond the border of the entirety of the vinyl decal with the first coat of the finish; and
l. drying the first coat of the finish.

2. The method of claim 1, wherein the sealer is a waterborne polyurethane hybrid.

3. The method of claim 1, wherein the finish is an oil-based poly finish.

4. The method of claim 1, wherein the finish is a water based finish.

5. The method of claim 1, further comprising the step of applying a hardwood cleaner to the first portion of the second sealed surface before applying the vinyl decal to the second sealed surface.

6. The method of claim 5, further comprising the step of, after applying the vinyl decal to the second sealed surface, smoothing the vinyl decal by applying pressure to the vinyl decal such that an excess portion of the hardwood cleaner is removed from under the vinyl decal.

7. The method of claim 1, further comprising the step of after applying the third sealed surface, applying a fourth coat of the sealer to the third sealed surface prior to applying the first coat of finish.

8. The method of claim 1, wherein the step of applying the vinyl decal comprises applying the vinyl decal via a vinyl applicator device, wherein the vinyl applicator device comprises a spool configured to apply the vinyl decal to the first portion of the second sealed surface, further wherein the vinyl applicator device comprises a laser configured to assist in applying the vinyl decal to a correct position on the abraded second sealed surface.

9. The method of claim 1, wherein the step of applying the vinyl decal comprises applying the vinyl decal via a hinge method, wherein the hinge method comprises applying a first portion of the vinyl decal to the second sealed surface prior to applying a second portion of the vinyl decal to the second sealed surface.

10. A method for installing a graphic design on a flooring surface, the method comprising the steps of:

a. prepping the flooring surface to provide a raw surface;
b. applying a first coat of a sealer to the raw surface;
c. drying the first coat of the sealer to create a first sealed surface;
d. abrading the first sealed surface with an abrasive pad to create an abraded first sealed surface;
e. applying a vinyl decal comprising the graphic design on a first portion of the abraded first sealed surface thereby creating an area covered by the vinyl decal;
f. applying a second coat of the sealer to the vinyl decal on the area covered by the vinyl decal and to a second area of the abraded first sealed surface, wherein the second portion of the abraded first sealed surface corresponds to all areas of the abraded first sealed surface not covered by the vinyl decal, thereby applying the second coat of sealer both on the entirety of the area covered by the vinyl decal and the areas beyond a border of the entirety of the vinyl decal;
g. drying the second coat of the sealer to create a second sealed surface covering the entirety of the vinyl decal and the areas beyond the border of the entirety of the vinyl decal;
h. abrading the second sealed surface with an abrasive pad to create an abraded second sealed surface;
i. applying a third coat of the sealer to the abraded second sealed surface to create a third sealed surface;
j. abrading the third sealed surface with an abrasive pad to create an abraded third sealed surface; and
k. applying a first coat of a finish to the abraded third sealed surface thereby covering the entirety of the area covered by the vinyl decal and an area beyond the border of the entirety of the vinyl decal with the first coat of the finish; and
l. drying the first coat of the finish.

11. The method of claim 10, wherein the sealer is a waterborne polyurethane hybrid.

12. The method of claim 10, wherein the finish is an oil-based poly finish.

13. The method of claim 10, wherein the finish is a water based finish.

14. The method of claim 10, further comprising the step of applying a hardwood cleaner to the first portion of the abraded first sealed surface before applying the vinyl decal to the abraded first sealed surface.

15. The method of claim 14, further comprising the step of, after applying the vinyl decal to the abraded first sealed surface, smoothing the vinyl decal by applying pressure to the vinyl decal such that an excess portion of the hardwood cleaner is removed from under the vinyl decal.

16. The method of claim 10, wherein the step of applying the vinyl decal comprises applying the vinyl decal via a vinyl applicator device, wherein the vinyl applicator device comprises a spool configured to apply the vinyl decal to the first portion of the abraded first sealed surface, further wherein the vinyl applicator device comprises a laser configured to assist in applying the vinyl decal to a correct position on the abraded first sealed surface.

17. The method of claim 10, wherein the step of applying the vinyl decal comprises applying the vinyl decal via a hinge method, wherein the hinge method comprises applying a first portion of the vinyl decal to the abraded first sealed surface prior to applying a second portion of the vinyl decal to the abraded first sealed surface.

* * * * *